US005429455A

United States Patent [19]

Bone

[11] Patent Number: 5,429,455

[45] **Date of Patent: * Jul. 4, 1995**

[54] INTEGRATED COLUMN AND PILE

[75] Inventor: Michael C. Bone, Pembroke Pines, Fla.

[73] Assignee: State Paving Corporation, Fort Lauderdale, Fla.

[ * ] Notice: The portion of the term of this patent subsequent to Aug. 10, 2010 has been disclaimed.

[21] Appl. No.: 82,556

[22] Filed: Jun. 28, 1993

Related U.S. Application Data

[60] Division of Ser. No. 758,431, Aug. 29, 1991, Pat. No. 5,234,288, which is a continuation of Ser. No. 545,557, Jun. 29, 1990, abandoned.

[51] Int. Cl.[6] ..... E02D 5/30

[52] U.S. Cl. ..... 405/239; 405/231; 405/233; 405/256

[58] Field of Search ..... 405/239, 255, 256, 233, 405/232, 231, 230

[56] References Cited

U.S. PATENT DOCUMENTS

| | | | |
|---|---|---|---|
| 1,566,582 | 12/1925 | Cortes | 405/256 X |
| 3,191,390 | 6/1965 | Schutte | 405/239 X |
| 4,038,827 | 8/1977 | Pryke | 405/239 |
| 4,040,260 | 8/1977 | Pryke | 405/239 |
| 4,060,994 | 12/1977 | Chitis | 405/239 X |
| 4,127,002 | 11/1978 | DeWitt | 405/239 |
| 4,247,225 | 1/1981 | Chickini, Jr. et al. | 405/239 X |
| 4,293,242 | 10/1981 | Merjan | 405/239 |
| 4,715,745 | 12/1987 | Reichert et al. | 405/239 X |
| 5,234,288 | 8/1993 | Bone | 405/239 |

*Primary Examiner*—Dennis L. Taylor
*Attorney, Agent, or Firm*—Joseph Zallen

[57] ABSTRACT

An integral combination of column and pile for use in building structures in a sandy soil. The method of formation is to provide a ground situs of suitable depth and width formed preferably by an hydraulic-powered auger. The situs is then filled with a cementitious slurry. A reinforced precast concrete column is provided having reinforcing bars extending a substantial length out of its bottom. The exposed bars are inserted into the slurry until the column merges with the slurry. Upon the hardening of the slurry, the result is an integral column and pile set into the ground.

3 Claims, 4 Drawing Sheets

INTEGRATED COLUMN AND PILE

BACKGROUND OF INVENTION

This is a division of application Ser. No. 07/758,431, filed Aug. 29, 1991, now U.S. Pat. No. 5,234,288 which is a file wrapper continuation of Ser. No. 07/545,557, filed Jun. 29, 1990 now abandoned.

This invention relates to a column which can be used in soil having a high water table. In particular it relates to a combination of column and pile for use in a sandy soil.

In sandy soils auger-cast piles have been used to carry foundation loads. In a typical situation, an hydraulic-powered auger with continuous flighting is rotated into the soil to a predetermined depth. A mixture of sand and cement is then pumped through a hole in the auger's stem while the auger is being slowly withdrawn from the hole. The resultant cementitious mixture is of greater density than the surrounding soil and thus acts to support the sides of the hole. This supporting action is especially useful in locations such as Florida where loose sands and a high water table make drill holes unsuitable. After the hole has been filled with cementitious material and the auger removed, steel reinforcement is inserted so that the final product is a steel reinforced concrete support column or pile cast within the soil with anchor bolts at the top to connect to the columns or post which it is intended to support.

In the past when a contractor attempted to use concrete posts or columns with auger-cast piles, considerable amounts of the cementitious grout were displaced when the post was inserted into the hole, sometimes as much as one-half the volume of the hole. Accordingly, this has not been a feasible method.

OBJECTS OF INVENTION

The present invention avoids the problems of the prior art. It provides a unitary, integral column and pile seated in the ground, with no anchor bolts or the like being required. It provides such an integral column and pile which can be used in structures of all sorts, including buildings, posts which support panels, and large advertising signs.

Other objects and advantages of this invention will be apparent from the description and claims which follow taken together with the appended drawings.

SUMMARY OF INVENTION

The method of this invention comprises first preparing a hole of sufficient depth and cross-section. Then a mass of suitable, wet, cementitious material is inserted into the hole, a plurality of reinforcing bars extending out of the bottom of the column. The column is placed on the mass, until the bottom of the column member merges with the mass. The cementitious material is then permitted to harden. The result is an integral column and pile firmly rooted in the ground and capable of the support generally attributable to a column of its size, shape and composition.

One method of providing the mass of cementitious material in a hole of suitable depth and width is to use an auger having a central channel. As the auger rotates and cuts into the earth, soil is removed upwardly. Cementitious material is pumped through the channel which has a retaining means at the bottom. At the proper time the retaining means or valve is opened to that the cementitious material now flows into the empty space caused by the soil removal by the auger. When the auger is withdrawn, the pool of cementitious material is now available to receive the exposed reinforcing bars which extend out of the precast column.

The columns that can be used in this invention vary widely in size and shape as well as intended use. They can be used in building structures or, as shown in the illustrations, as posts for support of walls such as noise barriers or large advertising signs. The described method avoids the necessity for attaching a column or post to a set of reinforcing bars and/or anchor bolts separately inserted into the pool of cementitious material. False-work can be used to keep the precast column and its extending reinforcing bars in proper orientation until the cementitious material has reached a predetermined strength.

SPECIFIC EXAMPLES OF INVENTION

Figure 1:
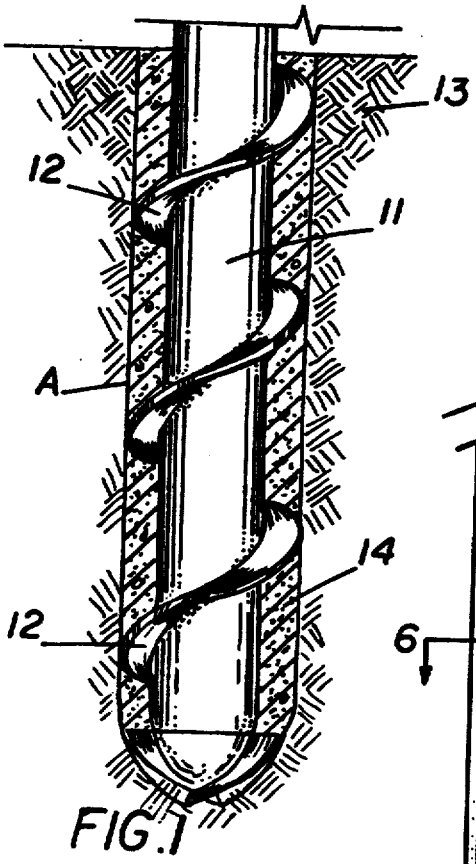
FIG. 1 is a vertical section partially broken away showing a hollow-shafted continuous-flight auger which is being screwed into an earth situs to drill a hole of requisite depth.
Figure 2:
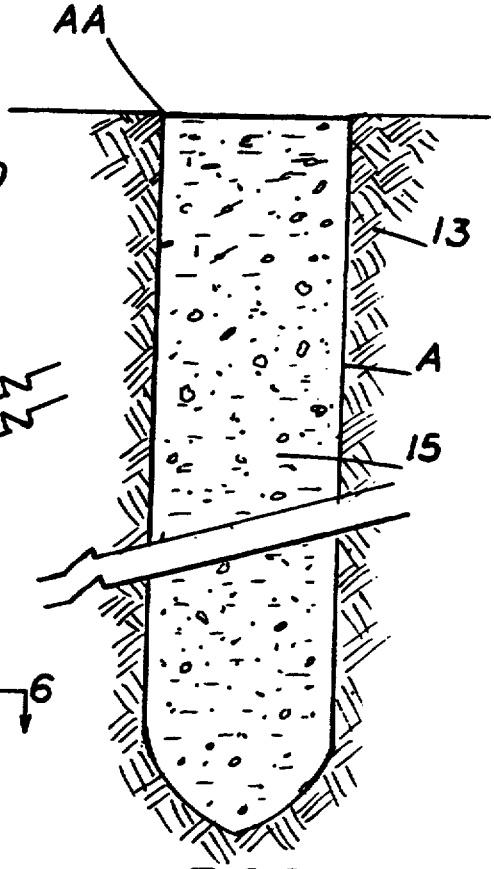
FIG. 2 is a vertical cross-section showing the drill situs filled with cementitious material.
Figure 3:
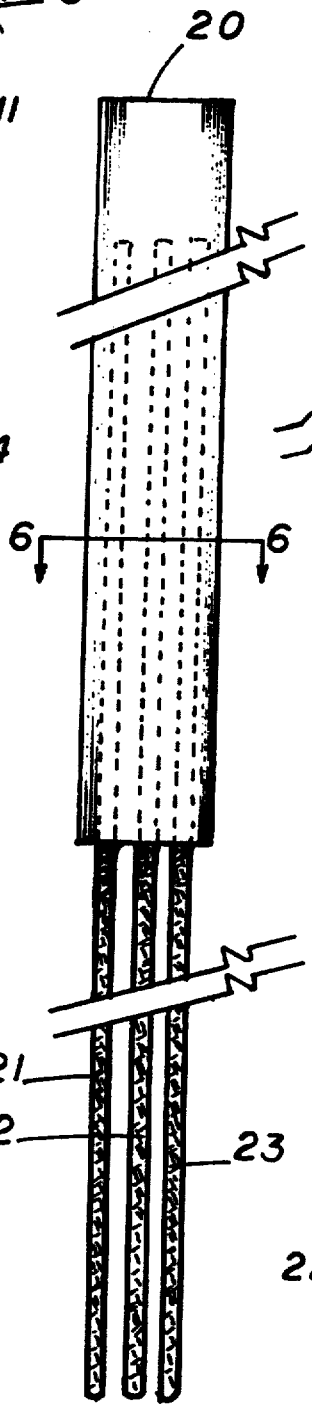
FIG. 3 is a front view of a reinforced concrete column with exposed reinforcing bars extending out of the bottom of the column.
Figure 5:
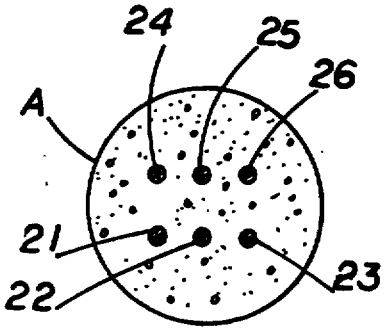
FIG. 5 is a cross-section along line 5—5 of FIG. 4.
Figure 6:
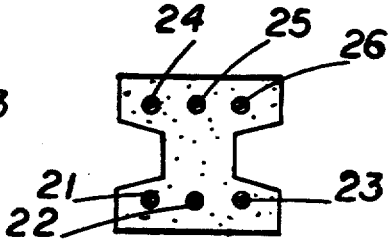
FIG. 6 is a transverse section along line 6—6 of FIG. 3.
Figure 4:
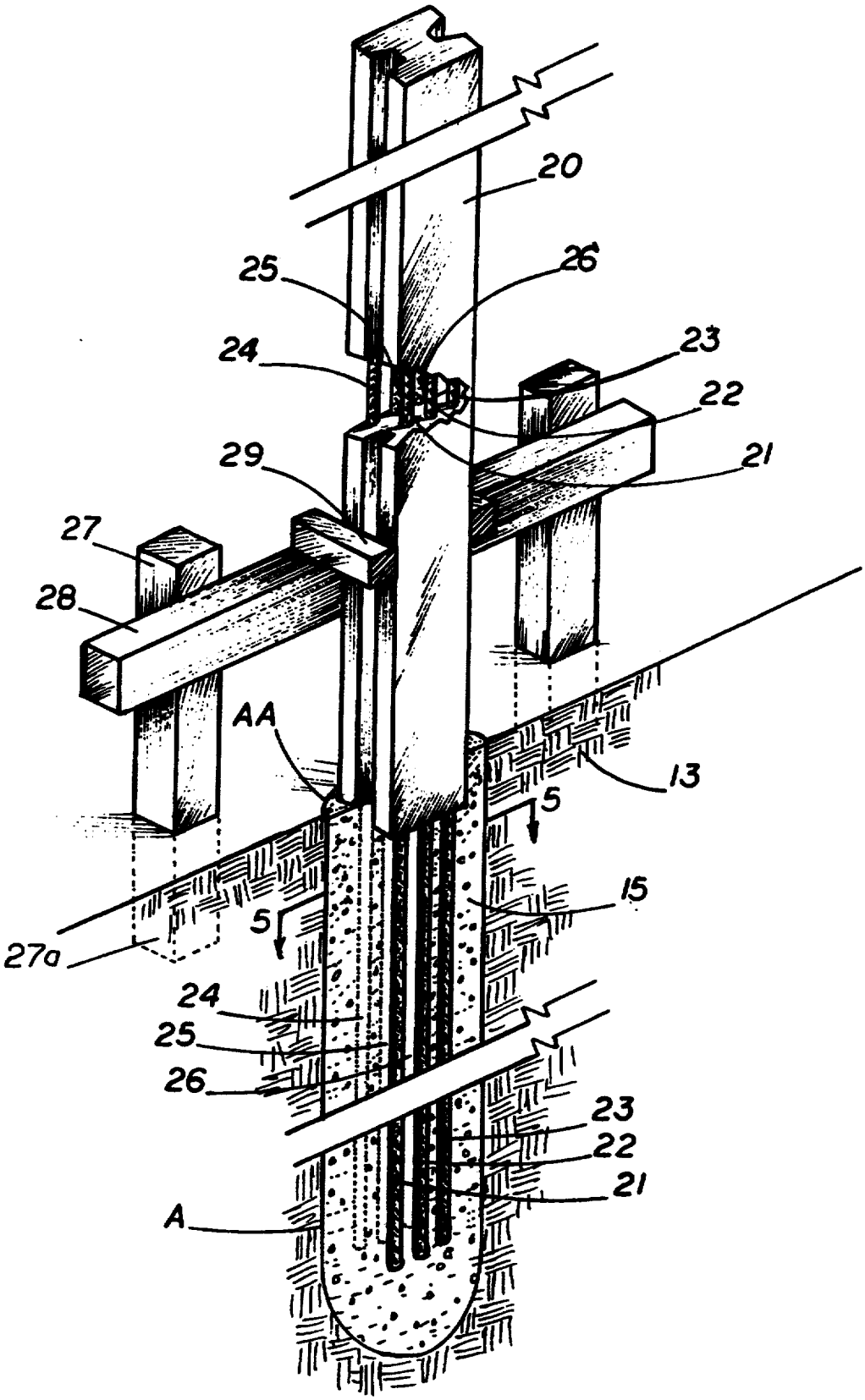
FIG. 4 is a perspective view with partial cutaway and partial vertical section showing a final product of the invention in this instance an integral post and pile.

As illustrated in FIGS. 1–6, the first step is to form a hole of suitable dimensions in the earth. As illustrated in FIG. 1 an auger 11 having a continuous flight 12 removes earth 14 as it penetrates the soil 13 to form the desired hole A. In a method similar to that described in the Turzillo patent, U.S. Pat. No. 3,512,366, cementitious slurry 15 is pumped into the central channel of auger 11 until it fills the hole A when the auger 11 is withdrawn. While the cementitious slurry 15 is still wet a precast concrete member 20, in this case a post for use in supporting noise barrier walls, is inserted into the slurry. Post 20 has exposed reinforcing bars 21–26 extending from its bottom. These bottom extensions are immersed in the slurry until the bottom of the column merges with the slurry. While the cementitious material is setting and in order to prevent misalignment, falsework, as illustrated in wood members 27–29, can used as a temporary support. Depending on the shape and size of the column, falsework is not always needed.

Figure 7:
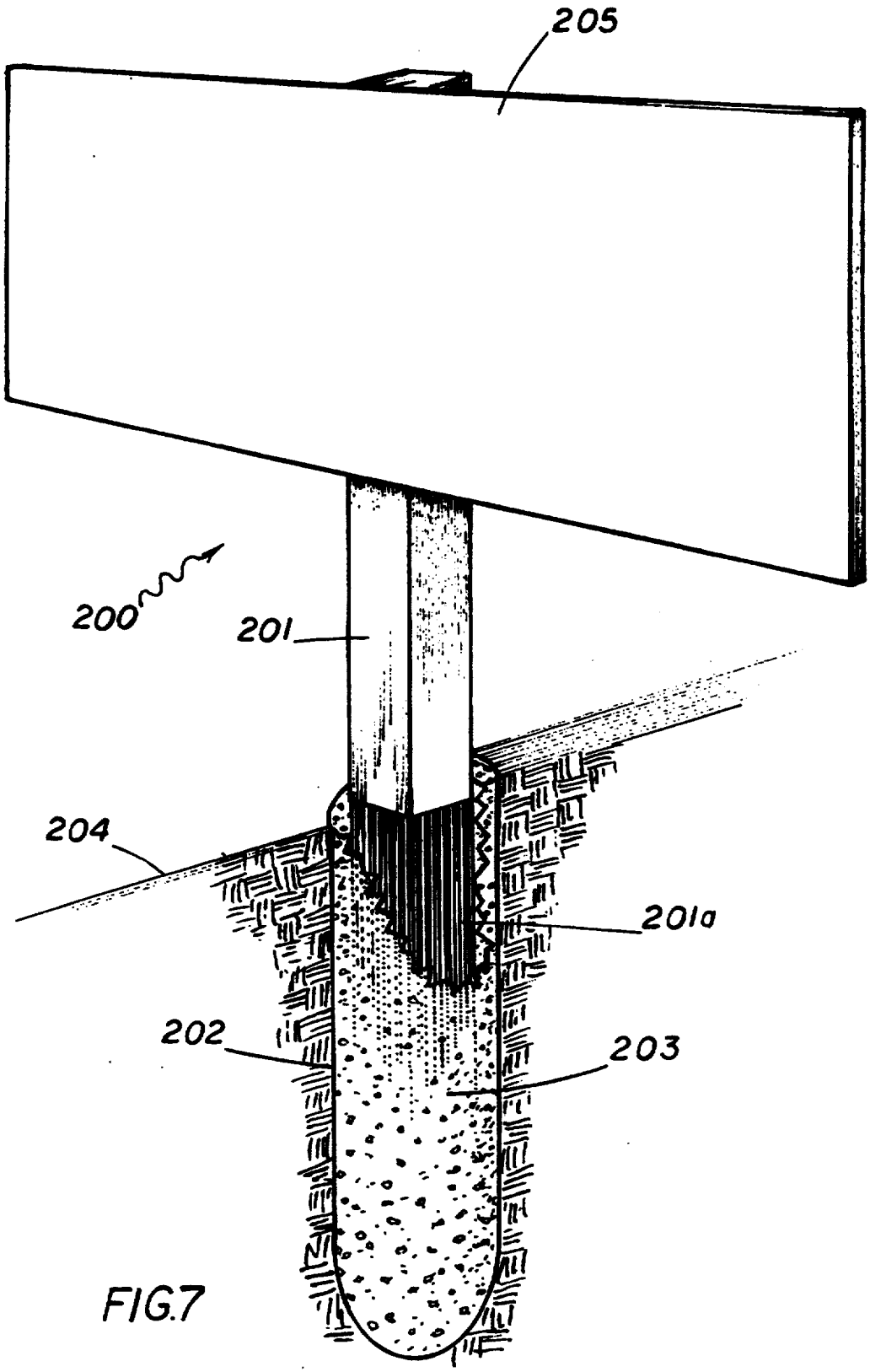
FIG. 7 is a perspective view with partial cutaway and a partial vertical section showing a corner of a building whose columns are made in accordance with this invention.

The building structure illustrated in FIG. 7 has its foundation and columns constructed in a similar manner as illustrated in FIGS. 1–6. The dimensions are selected in accordance with proper structural engineering principles.

Building column 101 extends from floor 105 through floor 104 and has reinforcing bars 101*a* which extend most of the depth of ground hole 108 and is covered by the hardened grout 108*a*. Similarly, column 102 extends from floor 105 through floor 104 to ground hole 109 filled with hardened grout 112. Column 103 is shown in partial breakaway to show its extended reinforcing bars 103*a* in hole 110 filled with grout 113. The remaining floors 106, 107, and columns of the building are formed in a conventional manner.

Figure 8:
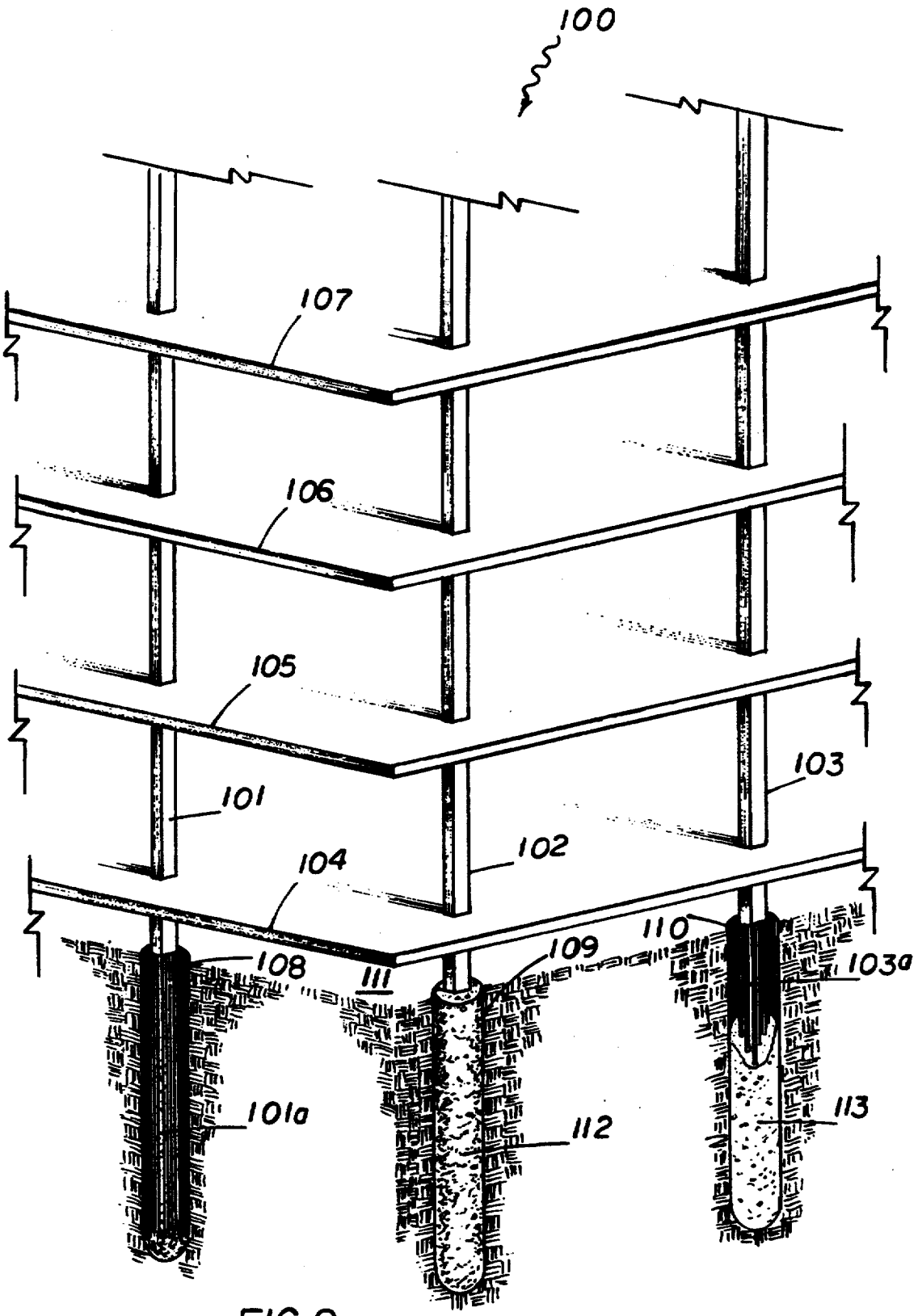
FIG. 8 is an advertising sign of very large dimension supported by a single integrated column and pile made in accordance with this invention.

The great strength of the integrated column-pile of this invention enables it to be utilized as a single support for a very large advertising sign 200, as for example, a sign 30 feet long as shown in FIG. 8. A hole 202 of about four foot diameter was prepared in ground 204 and filled with cementitious slurry 202 to receive the reinforcing bars 201*a* extending from the bottom of precast concrete column 201 which has a diameter of two feet. The sign 205 is attached to the upper portion of the column. Hitherto, complicated and expensive framing supports were required for such signs.

I claim:

1. A precast reinforced concrete member containing reinforcing bars which have exposed portions extending beyond one end of the member and parallel to the longitudinal dimension of the member; the number, size and length of such exposed portions being such as to provide sufficient strength when the end of said concrete member is merged with and the bars inserted into a foundation pile of initially wet, cementitious material, which material is then allowed to set; said exposed portions being further characterized in being completely surrounded by said cementitious material; said concrete member and said pile being merged without mechanical attachment.

2. A ground-supported structure comprising the integral combination of a precast column and a foundation; said foundation comprising a mass of initially wet cementitious material in a hole in the ground; said column comprising a precast reinforced concrete member whose reinforcing bars extend out of said member's bottom parallel to the longitudinal dimension of the member into said cementitious material and are completely surrounded by said cementitious material, the bottom of said column portion being merged with said cementitious material to form an integral structure embedded in the ground when said cementitious material has hardened; said column and said foundation being merged without mechanical attachment.

3. The combination of a post component and a foundation component; said foundation component occupying a hole in the ground and comprising initially wet, cementitious material; said post component comprising a precast reinforced concrete post having reinforcing bars which extend out from the bottom of said member parallel to the longitudinal dimension of the member and into said cementitious material, are completely surrounded by said cementitious material, and merge with said foundation component to form an integral unit embedded in the ground when said cementitious material has hardened; said post component and said foundation component being merged without mechanical attachment.

* * * * *